US009180446B2

(12) United States Patent
Reichmuth

(10) Patent No.: US 9,180,446 B2
(45) Date of Patent: Nov. 10, 2015

(54) MANUAL DOSING DEVICE

(71) Applicant: Eppendorf AG, Hamburg (DE)

(72) Inventor: Burkhardt Reichmuth, Hamburg (DE)

(73) Assignee: EPPENDORF AG, Hamburg (DE)

( * ) Notice: Subject to any disclaimer, the term of this patent is extended or adjusted under 35 U.S.C. 154(b) by 0 days.

(21) Appl. No.: 13/644,254

(22) Filed: Oct. 3, 2012

(65) Prior Publication Data

US 2013/0224087 A1 Aug. 29, 2013

Related U.S. Application Data

(60) Provisional application No. 61/543,246, filed on Oct. 4, 2011.

(51) Int. Cl.
*B01L 3/02* (2006.01)

(52) U.S. Cl.
CPC ..... *B01L 3/021* (2013.01); *B01L 3/0217* (2013.01); *B01L 3/0234* (2013.01); *B01L 2200/12* (2013.01); *B01L 2300/12* (2013.01)

(58) Field of Classification Search
CPC ..... B01L 3/02; B01L 3/021; B01L 3/0217; B01L 3/0227; B01L 3/0234; B01L 3/0275; B01L 9/54; B01L 9/543
USPC ..... 604/201, 68, 67, 154, 155, 240, 131; 73/864, 863.32, 864.01, 864.11, 73/864.14, 864.16; 422/546, 524–525, 422/501, 509, 511, 518, 521, 564
See application file for complete search history.

(56) References Cited

U.S. PATENT DOCUMENTS

| | | | | |
|---|---|---|---|---|
| 3,656,472 | A | 4/1972 | Ben Moura | |
| 2009/0139351 | A1 * | 6/2009 | Reichmuth et al. | 73/864.11 |
| 2012/0323177 | A1 * | 12/2012 | Adams et al. | 604/135 |

FOREIGN PATENT DOCUMENTS

| | | | |
|---|---|---|---|
| DE | 2 26145 | A1 | 6/1974 |
| DE | 29 06 904 | A1 | 9/1979 |
| DE | 44 37 716 | A1 | 7/1996 |
| FR | 2 220 135 | A7 | 9/1974 |
| GB | 1 463 807 | A | 2/1977 |
| WO | WO 2011051366 | * | 5/2011 |

* cited by examiner

*Primary Examiner* — Brian R Gordon
(74) *Attorney, Agent, or Firm* — Vidas, Arrett & Steinkraus, P.A.; Scott Vidas

(57) ABSTRACT

A manual dosing device for dosing liquids on which a syringe or pipette tip can be releasably held. The manual dosing device includes an elongated frame as a support structure, a mechanism for releasably holding a syringe or pipette tip at the bottom end of the frame, a drive member that attached above the mechanism for releasably holding to the frame, a displacement member for displacing a fluid in the syringe or pipette tip that can be driven by the drive means and are connected to the mechanism for releasably holding, and a housing encasing the frame.

14 Claims, 7 Drawing Sheets

MANUAL DOSING DEVICE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a manual dosing device for dosing liquids.

Manual dosing devices are dosing devices for dosing liquids on which a syringe or pipette tip can be releasably held. Syringes have a syringe cylinder with a syringe plunger which can move therein, and an opening connecting the syringe cylinder to the environment for drawing and releasing liquid. The opening is generally arranged in a tip on the floor of the syringe cylinder. Pipette tips are small tubes that generally narrow downward and have a bottom tip opening for drawing and releasing liquid, and a top tip opening to be connected with a displacement device for air. Manual dosing devices are held in one hand by the user while dosing so that the syringe, or pipette tip, held thereon can be aligned with a vessel or another object from which liquid is to be withdrawn or toward which liquid is to be released. The user can control the withdrawal and release of liquids and possibly additional functions with the same hand with which he holds the manual dosing device. Manual dosing devices are in particular used in laboratories for dosing liquids.

Manual dosing devices are designed as air cushion dosing devices and positive displacement dosing devices. Air cushion dosing devices have a seat for releasably holding a pipette tip at their top tip opening. A displacement unit for air is integrated in the manual dosing device and, communicating by means of a channel, is connected to a hole in the seat. An air cushion is displaced by means of the displacement unit so that liquid is aspirated into, or discharged from, the bottom tip opening depending on the direction of displacement of the air cushion. The displacement unit is usually a cylinder having a plunger displaceable therein. The plunger is driven by means of a drive unit. Manual dosing devices that function with an air cushion are termed "pipettes".

Direct displacement dosing devices work together with syringes. The syringes can be coupled to or released from the positive displacement dosing devices. The syringe cylinder is held in the positive displacement dosing device, and the syringe plunger is held in a seat body that can be displaced by means of a drive unit. By means of the drive unit, the syringe plunger is moved back and forth so that the liquid is aspirated into, or discharged from, an opening in the syringe.

Direct displacement devices that work together with small syringes with a similar size and shape as pipette tips are also termed "direct displacement pipettes". Direct displacement dosing devices that work together with large syringes which are usually emptied in several steps are also termed "dispensers".

Pipette tips and syringes are preferably made of plastic and can be thrown away after being used and replaced with new pipette tips or syringes.

Known manual dosing devices have a mechanical drive unit or electromechanical drive units. In addition, manual dosing devices having a manual drive unit with an electromechanical support ("servo drive unit") are known. In addition, there are manual dosing devices with a fixed dosing volume, and manual dosing devices with an adjustable dosing volume. Furthermore, there are manual dosing devices with only one channel for use with only a single syringe or pipette tip, and manual dosing devices with a plurality of channels for the simultaneous use of a plurality of syringes or pipette tips. The invention relates to all of the above types of manual dosing devices.

Conventional manual dosing devices have a housing shaped as a handle made of a rigid plastic. These contain means for holding a syringe or pipette tip, a drive device, means for transmitting the drive movement of the drive device to a plunger or syringe, or a displacement unit for displacing an air cushion, operating elements and possibly display elements or other components. In the case of electrically-driven manual dosing devices, an electric drive motor, electronic control unit and batteries or rechargeable batteries are arranged in the housing. A plurality of components are therefore accommodated in a very small space in the housings of manual dosing devices. The housing simultaneously forms the support structure of the known manual dosing devices.

EP 2 033 712 A2, the entire contents of which is incorporated herein by reference, describes a dispenser that has a seat in a bottom end area of the housing for a syringe flange of a syringe. The syringe flange is held by means of syringe gripping levers that are mounted on pivot shafts in the bottom area of housing. Leaf springs are arranged on the inner jacket of the housing, and their top ends are fixed in the bottom area of the housing. The bottom ends of the leaf springs press against the inside of the syringe gripping levers to pretension them toward the position of gripping behind the syringe flange.

A spring-loaded thrust bearing is arranged in the seat against which the top side of the syringe flange can be pressed. The thrust bearing has sensors for scanning a code on the top side of the syringe flange.

A seat body with a plunger seat is arranged in the housing into which an upward projecting end section of a syringe plunger of the syringe can be inserted. Plunger gripping levers are mounted in the seat body that can grip behind a plunger collar on the outer end of the syringe plunger. The plunger gripping levers are pretensioned by legs springs toward a position in which they grip behind the plunger collar.

The seat body is driven by means of mechanical plunger positioning elements. These comprise a lifting unit connected to the seat body which extends out of the housing. Furthermore, the plunger positioning elements comprise a threaded spindle or rack that is also firmly attached to the seat body. An adjusting sleeve is seated on the threaded spindle, and its axial position is adjustable on the threaded spindle by means of an adjustment knob. Arranged in the top area of the housing is an actuating unit that has a pivoting actuating lever and can be actuated from the outside by means of an actuating button. A pawl is pivotably arranged on the actuating lever. The actuating lever is pressed upward by a spring, and the pawl is pretensioned by the spring toward the threaded spindle.

The actuating unit, the adjustment knob and the spindle are mounted in a plate-like holder with a laterally projecting bearing bracket that is inserted in the housing.

When a syringe is inserted in the syringe seat and held in the housing by means of the syringe gripping levers and the plunger gripping levers, the liquid can be drawn upward by moving the lifting unit. A dosing quantity is adjusted using the adjustment knob. By actuating the actuating unit, the syringe plunger is moved downward, and the desired amount of liquid is released. With each actuating stroke, the pawl falls into the threaded rod when it reaches the bottom end of the adjusting sleeve. The released dosing amount is set by adjusting the adjusting sleeve using the adjustment knob.

The actuating unit, the adjustment knob and the spindle can be premounted in the holder before it is inserted in the housing. Additional elements are not part of the holder or are mounted on it. In particular, the holder for the syringe flange is part of the housing. The spring-tensioned thrust bearing, the syringe gripping levers and the leaf springs are mounted in the housing. These means for holding the syringe must be mounted separately by the holder in the housing. The housing must therefore be very strong since drawing liquid into the syringe and ejecting liquid from the syringe exerts strong force on the means for holding the syringe. This restricts the selection of usable materials.

The disadvantage of known manual dosing devices is that the housing does not sit well in the hand, easily becomes dirty and is difficult to clean.

Against this background, the objective of the invention is to create a haptically improved manual dosing device.

BRIEF SUMMARY OF THE INVENTION

The objective is achieved by a manual dosing device. Advantageous embodiments of the manual dosing device are discussed in further detail below.

The manual dosing device according to the invention has:

A long frame as a support structure,

Means for releasably holding a syringe or pipette tip that are arranged at the bottom end of the frame, Drive means that are attached above the means for releasably holding to the frame, At least one displacement means for displacing a fluid in the syringe or pipette tip that can be driven by the drive means and are connected to the means for releasably holding, and A housing encasing the frame.

The support structure of the manual dosing device according to the invention is an elongated frame. The means for releasably holding the syringe or pipette tip are arranged on the frame. They can be a part of the frame or attached to it. The drive means are attached to the frame. The means for releasably holding and the drive means are connected to each other by displacement means. In a version the displacement means are means for transmitting the movement generated by the drive means to the syringe plunger of a syringe. To this end, the displacement means are releasably connected to means for releasably holding the syringe plunger. When the drive means generate a linear drive movement, the transmission means can be a rod that is drivable by the drive means and is connected to means for releasably holding the syringe plunger and that is axially guided on the frame. A positive displacement dosing device is thereby realized. In the other versions, the displacement means are a displacement unit for displacing a column of air. The displacement unit is preferably a cylinder and the plungers displaceable therein. The cylinder is connected to the means for releasably holding via a channel with a hole to the means for releasably holding that communicate with the top tip opening of a pipette tip when the means for releasably holding hold a pipette tip. The displacement unit is fixed to the frame. When designed as a cylinder with a plunger that is displaceable therein, the cylinder is fixed to the frame. An air cushion dosing device is thereby realized. The amount of drawn and released liquid is set by the amount which the plunger or air column is displaced by the displacement means. With an air cushion dosing device having a cylinder and displaceable plunger therein, the displacement means preferably have a plunger rod that is connected to the plunger and has a pushbutton on the top end and a return spring which presses against the frame, or against the plunger rod or pushbutton. The return spring presses the plunger upward into a home position from which air can be ejected from the displacement device by actuating the pushbutton against the effect of the return spring.

When the drive means drive the displacement means, forces are introduced into the frame. If the displacement means are transmission means for transmitting movement to a syringe plunger, these forces are transmitted by the drive means and means for releasably holding the syringe flange to the frame. When the displacement means are a displacement unit, these forces act between the drive means and the frame as well as between the displacement unit and the frame. These forces depend especially on the amount and viscosity of the liquid to be dosed. The frame is designed so that it does not significantly deform under the exerted forces. This ensures that the movable elements of the displacement means are reproducibly moved with the desired precision. The desired dosing precision is thereby achieved. The forces acting when the syringe or pipette tip is connected to the manual dosing device are also absorbed by the frame. The frame is preferably made of a polyether ketone (PEEK) that is distinguished by its enormous stability. The housing is preferably only mounted to the frame at a few points to relieve stress on the housing. The housing is preferably guided in a longitudinal direction on the frame and fixed at a few positions (such as only one or two positions) so that the frame can extend or retract in the longitudinal direction with reference to the housing without transmitting significant force to the housing. Consequently, the force arising during use can be substantially absorbed by the frame, thus relieving stress on housing.

The particular properties of the frame give the designer greater freedom in selecting the housing materials and designing and dimensioning the housing. It is in particular possible to use soft housing materials and design and dimension the housing such that the haptics of the manual dosing device are particularly pleasant. The design with a frame therefore makes it possible to use a particularly soft housing with improved haptics. The frame only partially supports the housing; in particular, the areas of the housing that are not supported are designed to be particularly easily shapable which is perceived as tactically pleasant by the user holding such a manual dosing device in his hand. The special properties of the frame make it possible to also use housing materials that have a special chemical resistance, and/or are dirt repellent, and/or can be easily cleaned, and/or are more easily processable, and/or are particularly economical. Forces introduced into the housing by the hand of the user, especially when actuating the control elements of the manual dosing device, are captured by a large area and transferred to the frame so that the housing is not overloaded. Another advantage is that using a frame as a support structure makes it possible to pre-mount the components of the manual dosing device on the frame and test the manual dosing device before the housing is attached. In addition, the design according to the invention of the manual dosing device makes it easier to use carryover parts (COPs) in different manual dosing devices. In particular, different manual dosing devices can be provided with the same frame which is equipped with different components depending on the product. The different products may optionally be differentiated by a different housing.

According to one embodiment, the frame has a plurality of frame parts that are joined and firmly connected with each other. Dividing the frame into a plurality of frame parts makes it possible to separately premount components on different frame parts and thereby prepare assemblies. In addition, differently arranged manual dosing devices can be partially designed with equal respectively similar frame parts and partially with different frame parts. According to a preferred embodiment, the frame has a bottom part and top part. The bottom part of the frame is preferably equipped with the means for releasably holding a syringe or pipette tip, and the top part is preferably equipped with drive means and displacement means.

According to another embodiment, the bottom part and top part have interlocking connecting structures, and these connecting structures have fastening means that connect with each other. The connecting structures are for example eyes that are connected to different frame parts, overlap each other and are connected by means of pins.

According to a preferred embodiment, the frame has spaced, parallel longitudinal members. Primarily axial forces act when the drive means are actuated. These are transmitted into the longitudinal members. The longitudinal members can also absorb forces that are exerted by the hand of the user on the side of housing. In addition, the advantage of the longitudinal members is that they can be accommodated in the housing in a space-saving manner. The manual dosing device according to the invention can therefore be designed particularly compact. A plurality of frame parts of the frame can have parallel longitudinal members.

According to a preferred embodiment, the manual dosing device only has two parallel longitudinal members.

According to a preferred embodiment, the longitudinal members are in a bottom part and/or a top part of the frame.

According to another embodiment, the longitudinal members are connected on the bottom end to the means for releasably holding a syringe or pipette tip. According to another embodiment, the load carriers are connected on the bottom end with a support plate. The support plate is a component of the means for releasably holding a syringe or pipette tip. The support plate can form a stop for a syringe flange of a syringe or a carrier for a seat of a pipette tip. When the support plate is a stop for a syringe flange, it is designed according to one embodiment approximately in the shape of an annular disk.

According to one embodiment, the support plate is connected via fork-shaped connecting areas to the bottom ends of the longitudinal member. The fork-shaped connecting areas prevent the support plate from tipping under an uneven load.

According to another embodiment, the parallel longitudinal members are connected to each other at the top end of one bearing plate. According to another embodiment, operating means and/or display means for the manual dosing device are fastened to the bearing plate.

According to another embodiment, the parallel longitudinal members are bridged between the bottom end and top end by a cross brace. According to another embodiment, a slideway is integrated into the cross brace for a rod-shape displacement means.

According to another embodiment, the cross brace is arranged on a bottom end of the parallel load carriers of the top part.

According to another embodiment, the frame has two bearing blocks projecting from one side, and the housing accommodates the bearing blocks in a lateral convexity. The bearing blocks can serve to bear an actuating lever of a mechanically or electrically driven manual dosing device, especially when the manual dosing device is designed as a dispenser. The convexity in the housing can also be used as a hand rest since the manual dosing device rests on the top edge of the index finger or the neighboring palm when the actuating lever is actuated with the thumb. In the area of the convexity, the housing is supported by the bearing blocks which prevents overloading.

According to one embodiment, the bearing blocks project from two parallel longitudinal members of a top part of the frame.

According to one embodiment, the housing is divided in a longitudinal direction of the frame, and the frame parts have snap connections. According to a preferred embodiment, the house is divided in two. According to a preferred embodiment, the housing is divided in a plane that extends parallel to the two longitudinal members and/or perpendicular to the bearing blocks.

According to another embodiment, the housing is guided on the frame in the longitudinal direction of the elongated frame. This enables compensation for deformations in the housing from distention in a longitudinal direction of the frame. According to another embodiment, the frame is screwed to the housing at the bottom and/or top end. Housing parts are preferably snapped together, and the frame is additionally screwed to the housing.

According to a further embodiment, the housing is made of polypropylenes or another polyolefin.

According to an embodiment, the manual dosing device is rod-shaped. The manual dosing device accordingly has the shape of a rod. The manual dosing device is dimensioned so that can be held by the user in just one hand and operated with the same hand.

BRIEF DESCRIPTION OF THE SEVERAL VIEWS OF THE DRAWINGS

The invention is described in the following in more detail based on the drawings of exemplary embodiments. The drawings show.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In this patent application, the terms "bottom" and "top" refer to the preferred alignment of the manual dosing device when dosing in which the elongated housing is vertically aligned, and the syringe or pipette tip is arranged below the housing.

The manual dosing device shown in FIGS. 1 to 6 is a dispenser, i.e., a positive displacement dosing device by means of which a syringe can be emptied in a plurality of steps.

Figure 1:
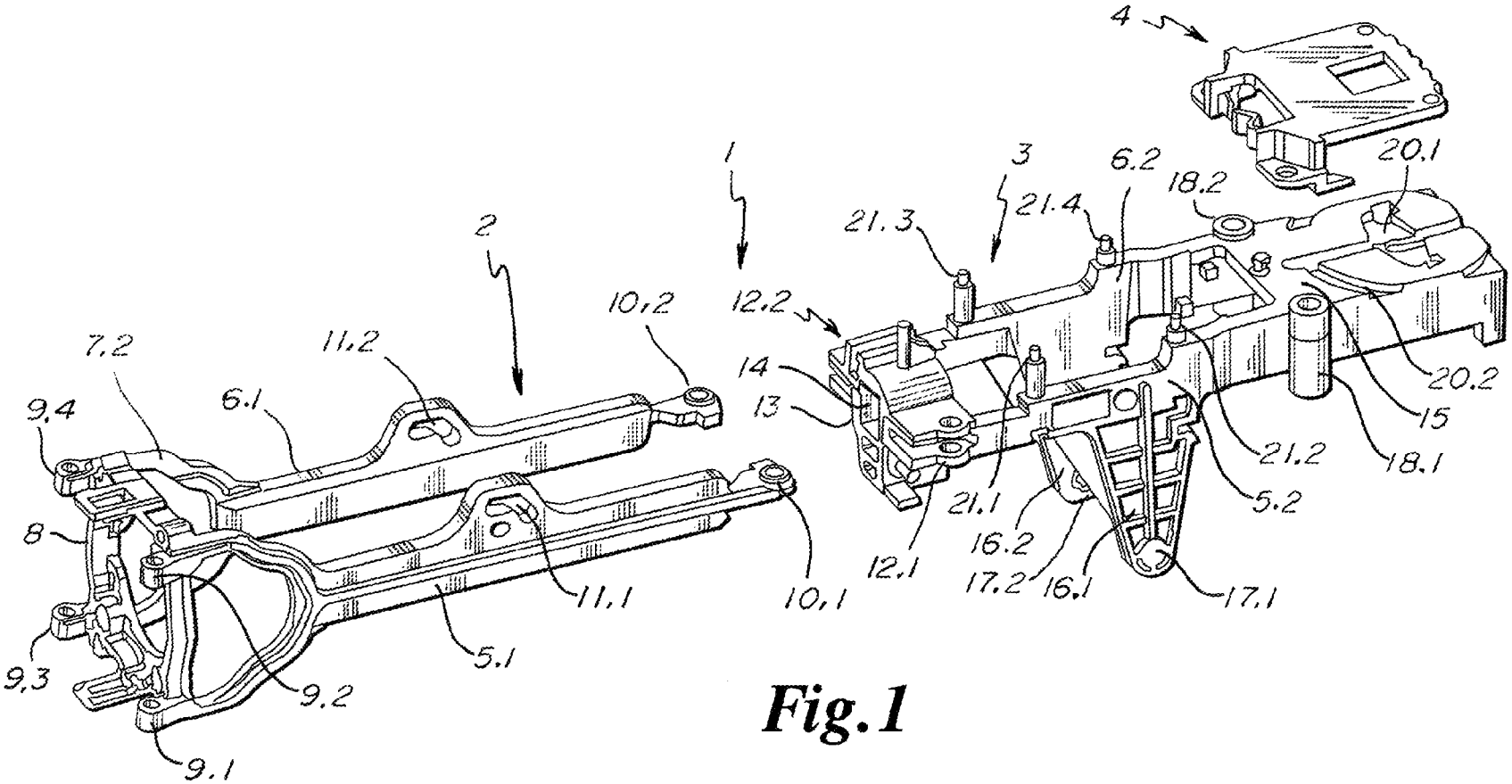
FIG. 1 A perspective exploded view of frame parts of the frame of a manual dosing device according to the invention.

According to FIG. 1, the frame 1 comprises a bottom part 2 and a top part 3. The top part 3 is assigned a cover 4 to hold a dial.

The bottom part comprises two parallel, strip-shaped longitudinal members 5.1, 6.1. These are connected at the bottom end via fork-shaped connecting areas 7.1, 7.2 to an annular-disc-shaped support plate 8. Bearing sleeves 9.1, 9.2, 9.3, 9.4 project from the support plate 8. At the top end, each longitudinal member of 5.1, 6.1 is connected to an annular-disc-shaped eye 10.1,10.2.

On one side, the two longitudinal members bear parallel gate guides 11.1, 11.2 that can guide a central release slider as described in detail in EP 2 033 712 A1.

The top part 3 has two parallel, strip-shaped longitudinal members 5.2, 6.2. These are each provided at the bottom end with a pair of concentric, annular-disc shaped eyes 12.1, 12.2. They are also bridged at the bottom end by a cross brace 13. In the middle, the cross brace 13 bears a slideway 14 having a passage that serves as a slideway for a rack parallel to the other longitudinal members 5.2, 6.2. At the top end of the top part 3, the spacing between the two longitudinal members 5.2, 6.2 is bridged by a bearing plate 15.

Between the cross brace 13 and the bearing plate 15, plate-like bearing blocks 16.1, 16.2 project from one side of the other longitudinal members 5.2, 6.2 and are ribbed on the outside for stabilization. At the bottom ends, the bearing blocks have bearing eyes 17.1, 17.2 that are flush with each other on the insides facing each other.

On the sides of the bearing plate 15, additional bearing sleeves 18.1, 18.2 are integrated in the longitudinal members 5.2, 6.2 to fix the cover 4.

The top side of the bearing plate 15 has milled recesses 20.1, 20.2 to receive a spring bearing and a guide contour of a dial (for adjusting a dose in volume).

Bearing pins 21.1, 21.2, 21.3, 21.4 project from the side of the other longitudinal members 5.2, 6.2 that are opposite the bearing blocks 16.1,16.2.

Figure 2:
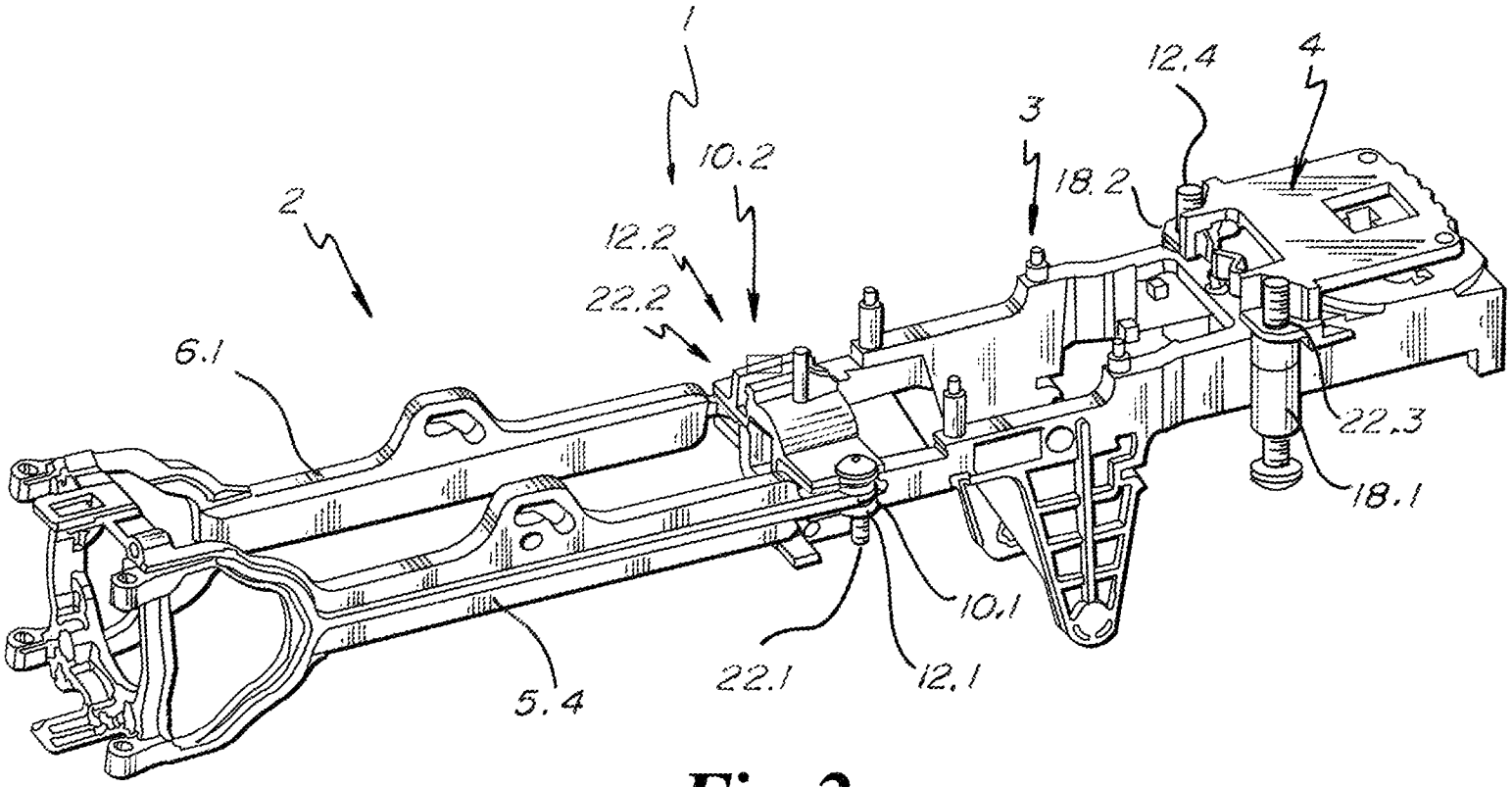
FIG. 2 Perspective view at an angle from above and from the side of assembled frame parts from FIG. 1.

According to FIG. 2, the top part 3 and the bottom part 2 are joined in a positive connection by inserting the eyes 10.1, 10.2 at the top end of the bearing members 5.1, 5.2 between the pair of eyes 12.1, 12.2 on the bottom ends of the other longitudinal members 5.2, 6.2 and screwing in screws 22.1, 22.2 into the eyes 10.1, 10.2, 12.1,12.2. In addition, the cover 4 is fixed to the top part 3 by screws 22.3, 22.4 screwed into the bearing sleeves 18.1,18.2 and holding plates 23.1, 23.2 of the cover 4.

Figure 3:
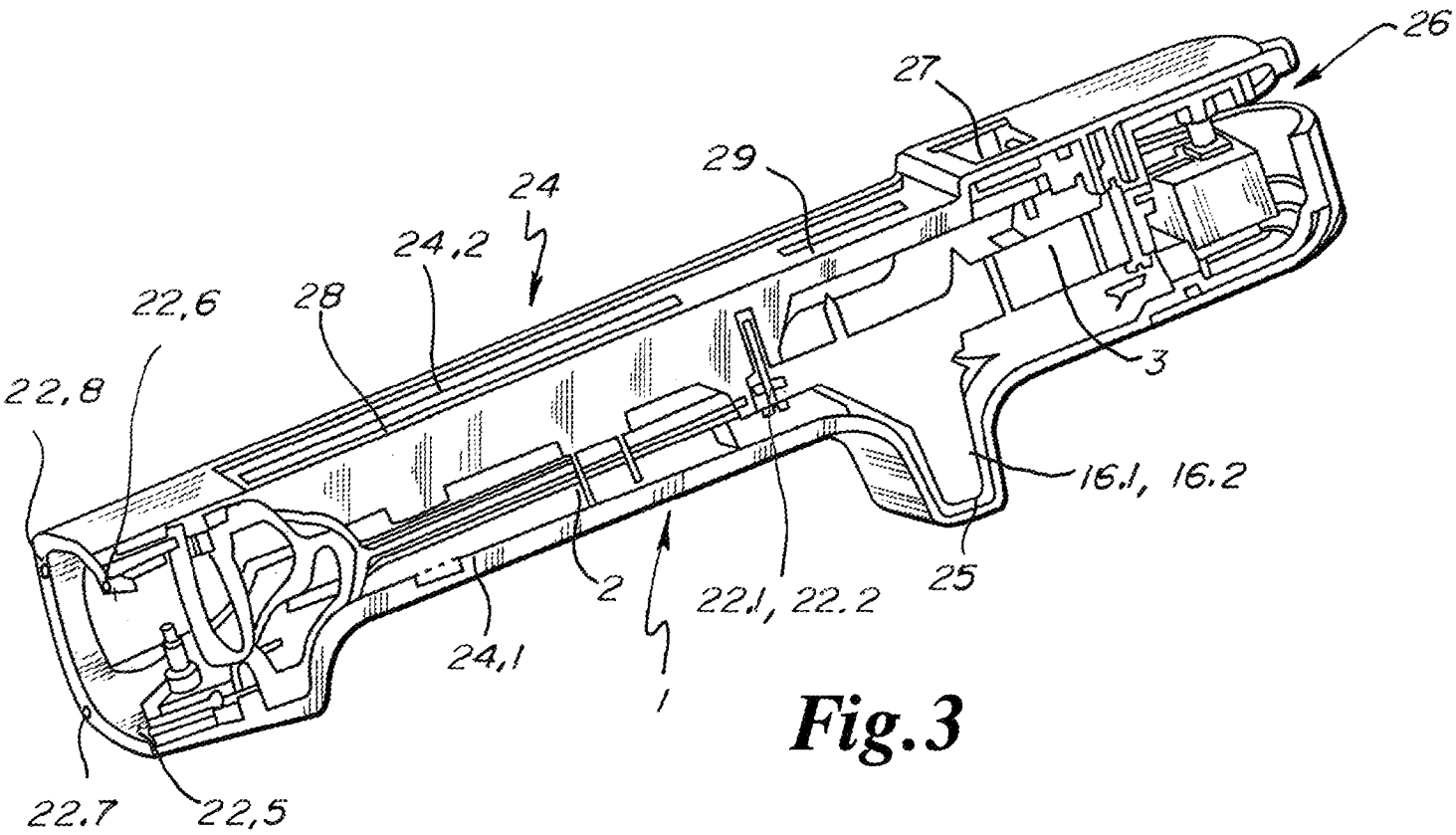
FIG. 3 The frame from FIG. 2 inserted in a housing in a perspective view at an angle from above or from the side of a longitudinal section of the housing.

The long, elongated frame 1 formed in this manner is inserted in a two-part housing 24 according to FIG. 3 consisting of a thin and soft material (such as polypropylene). The housing is formed by two joined, shell-shaped housing parts 24.1, 24.2. The bottom shell shaped housing part 24.1 in FIG. 3 is lower than the top shell shaped housing part 24.2. The housing parts have snap connection means on the edges to be connected to each other so that they can be snapped together. In addition, the frame 1 is screwed to the two housing parts 24.1, 24.2 by means of screws 22.1, 22.2 that screw the top part 3 and the bottom part 2 of the frame together, and by means of screws 22.3, 22.4 that screw the cover 4 to the top part 3.

At the front face, the two housing parts 24.1, 24.2 are screwed to the support plate 8 of the frame 1 by means of axially aligned screws 22.5, 22.6, 22.7, 22.8.

The bottom housing part 24.1 in FIG. 3 has a convexity 25 that receives the bearing blocks 16.1, 16.2. This formation simultaneously forms a finger rest.

A slot-like opening 26 remains between the two housing parts 24.1,24.2 through which the edge area of a dial can project outward.

In addition, the top housing part 24.2 in FIG. 3 has a window 27 for an LCD display (for example to display the dosing volume, the number of steps and/or the employed tips or syringe type) and slots 28, 29 for a lifting lever and an actuating lever.

Figure 4:
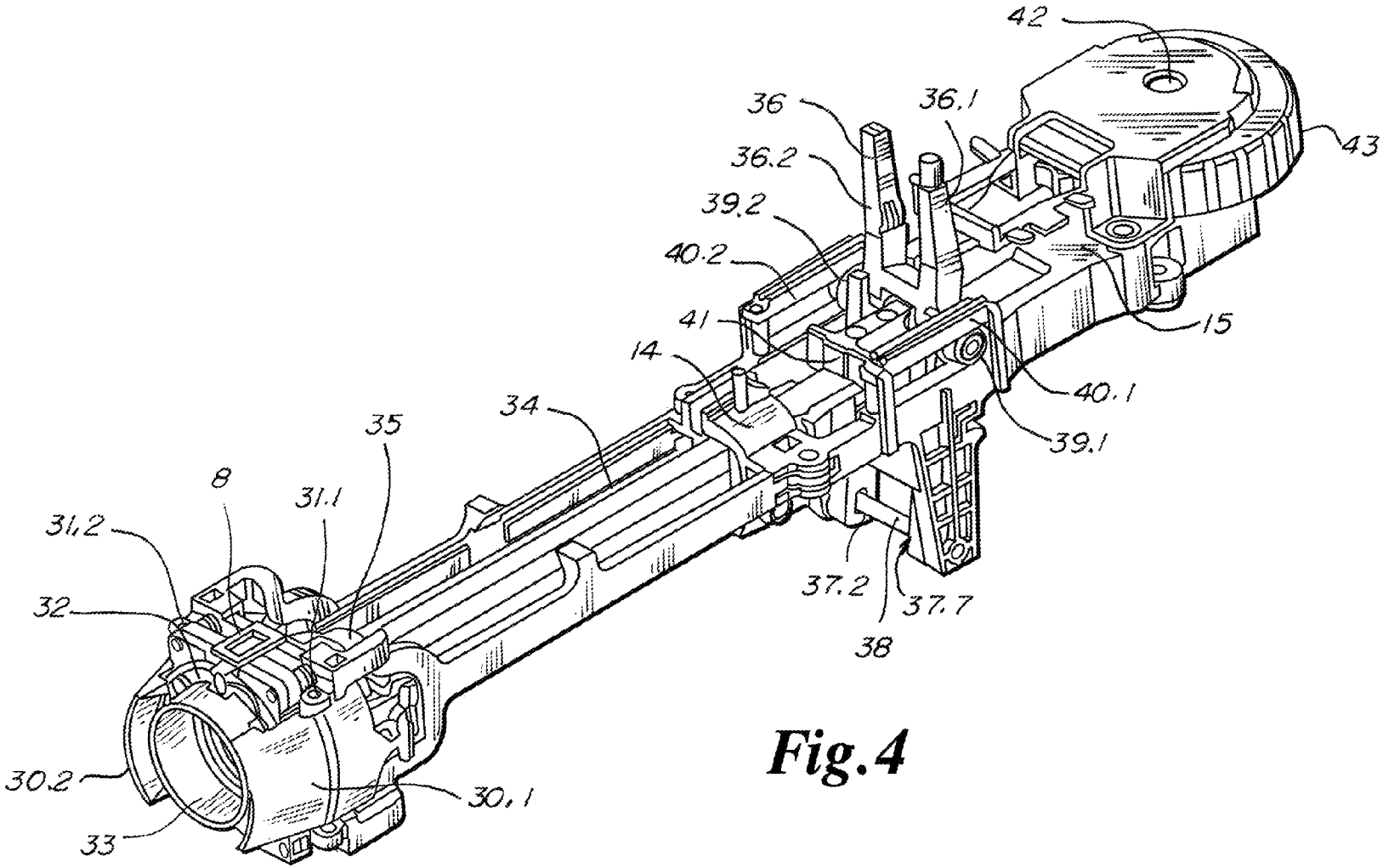
FIG. 4 The frame from FIG. 2 equipped with components; view at an angle from above or from the side of a longitudinal section of the housing.

According to FIG. 4, the frame 1 is equipped with syringe plunger gripping levers 30.1, 30.2 that are mounted in the bearing sleeves 9.1, 9.2, 9.3 9.4 by means of four pins (only two are shown (31.1, 31.2)). In an alternative embodiment, only two pins are used. In addition, and annular-disc-shaped sensor plate 32 is arranged on the support plate 8 for scanning a code on the top edge of a syringe flange. The sensor plate 32 surrounds a centering ring 33 that engages in the cylinder of a syringe which is fixed to the sensor plate 32 by means of the syringe plunger gripping levers 30.1, 30.2. The centering ring corresponds to the centering ring disclosed in DE 10 2009 034897 A, the entire contents of which is hereby incorporated by reference.

A rack 34 is inserted in the slideway 14 and has a bell-shaped seat body 35 at the bottom end to receive the top end of a syringe plunger or a plunger rod connected to the syringe plunger. Not shown syringe plunger gripping levers are mounted in this seat body 35. Instead of a rack 34, a preferred embodiment has a threaded rod. The rack 34 operates as a displacement means.

The details of this syringe fastening are described in EP 0 656 229 B1 and U.S. Pat. No. 5,620,660A. Details on the scanning of a code on the syringe flange of a syringe are described in EP 0 657 216 B1 and U.S. Pat. No. 5,620,661A. The entire contents of each of these documents is included in its entirety in the present application by reference.

An actuating lever 36 is mounted on the bearing blocks 16.1,16.2. The actuating lever 36 has two arms and a slot 37.1, 37.2 in its two parallel arms 36.1, 36.2 that is guided on a shaft 38 which is inserted in the bearing eyes 17.1, 17.2 of the bearing blocks 16.1, 16.2. At the top, the actuating lever 36 is guided on both sides via guide rollers 39.1, 39.2 in straight guides 40.1, 40.2 at the top edge of the other longitudinal members 5.2, 6.2. An actuating button can be placed on the ends of the actuating lever 36 pointing up in FIG. 4.

The actuating lever 36 has a pivotably mounted pawl 41 between its two arms 36.1, 36.2.

Between the bearing plate 15 and the cover 4, the dial 43 is rotatably mounted on another shaft 42.

The dial 43 is provided with an adjusting sleeve 43.1 (or cover strip) (see FIG. 6) that, in FIG. 4, covers the top side of the rack 34 that is provided with teeth. The position of the adjusting sleeve can be adjusted with the dial 43 within the range over which the pawl 41 moves when the actuating lever 36 is swung within the limits defined by the slideways 40.1, 40.2. By adjusting the dial 43, the position of the adjusting sleeve 43.1 can be specified behind which the pawl 41 then falls into the teeth to advance them up to the stop at the top side of the slideway 14.

In addition, the frame 1 is equipped with spring means that press the syringe plunger gripping levers 30.1, 30.2 into a pivot position in which it holds a syringe. Additional spring means press the actuating lever 36 into the pivot position shown in FIG. 4 and press the pawl 41 against the teeth of the rack 34. The drive means include actuating lever 36 and pawls 41.

At the bottom end of the rack 34 are connecting means—not shown—that make it possible to connect the rack with a lifting button.

The actuating lever 36, the rack 34, the adjusting sleeve 43.1 and the lifting button form plunger positioning elements that for example are described in EP 2 033 712 A1 or US 2009/139351 A1. The entire contents of each of these documents is included in its entirety in the present application by reference.

The frame 1 equipped with components according to FIG. 4 can be subjected to function tests and calibration during production. Furthermore, the presettings of the manual dosing device can be made in this stage of assembly. This has the advantage that products without a housing that are faulty can be already identified in this stage, and they can be removed from production (in this stage). This reduces the consumption of housing material. Furthermore, this has the advantage that, depending on the type of problem, components mounted on the frame can be removed and replaced with others to create a flawless product, or alternately flawless components can be removed from the already equipped frame, and they can be used to manufacture other manual dosing devices.

Figure 5:
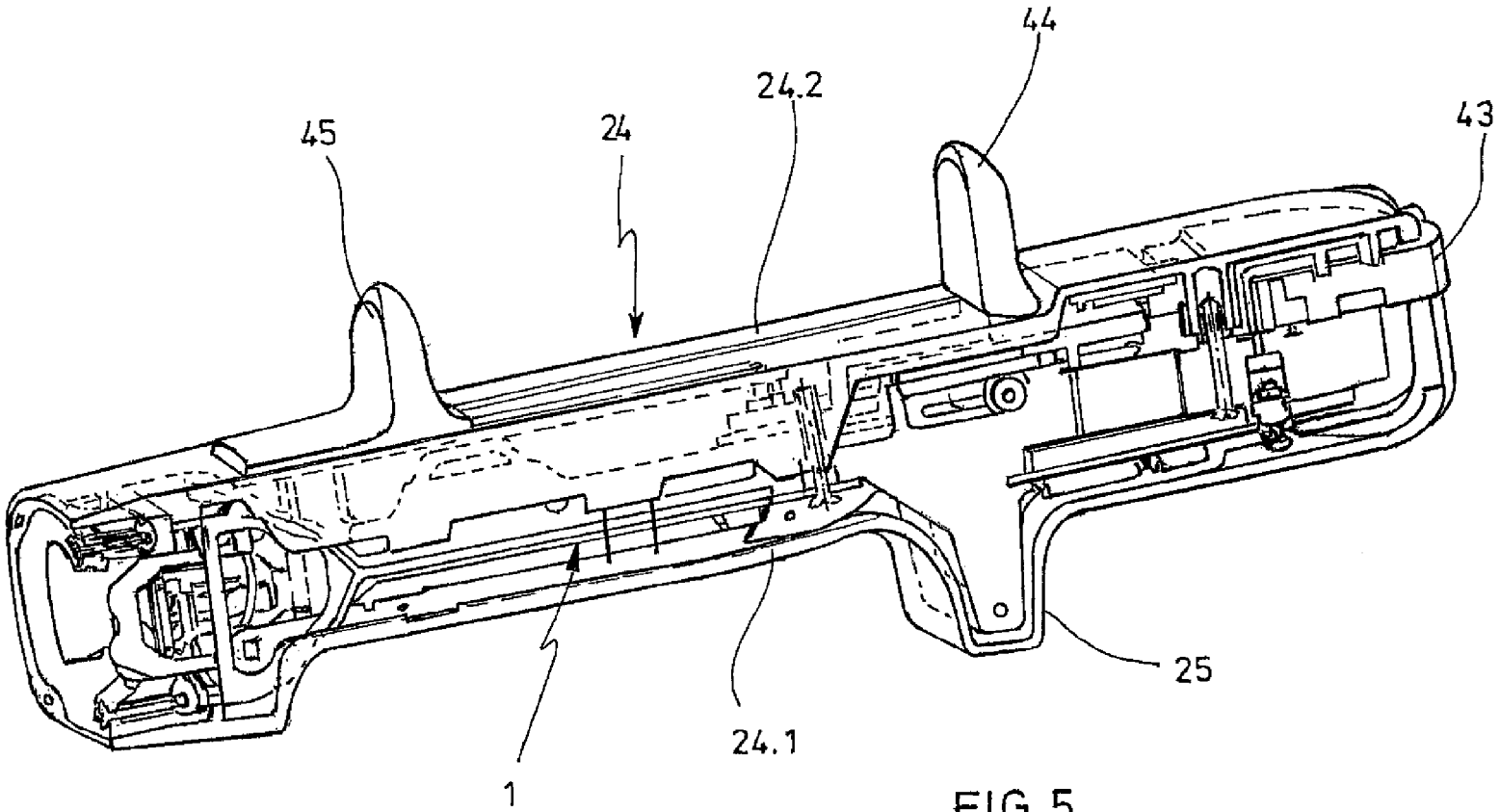
FIG. 5 The frame from FIG. 4 equipped with components inserted in a housing in a perspective view at an angle from above or from the side of a longitudinal section of the housing.
Figure 6:
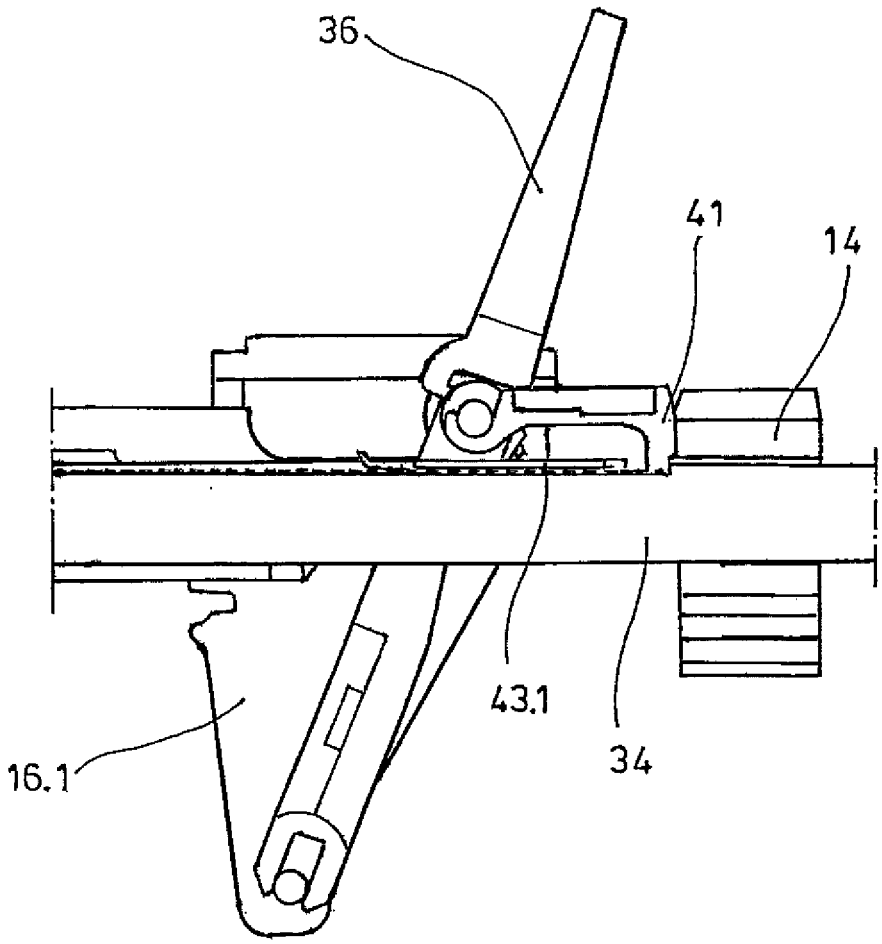
FIG. 6 Detail view from the left side of the equipped frame from FIG. 4.

According to FIG. 5, the equipped frame 1 is inserted in the housing 24 as illustrated in FIG. 3 with the unequipped frame 1. An actuating button 44 and a lift button 45 are mounted. The actuating units 44, 45 and the dial project out of the housing 24.

When a syringe is mounted, the axial forces are introduced via the support plate 8 into the frame 1 that abuts a large area of the housing 24. When the lift button 45 and the actuating button 44 are actuated, the axial forces are absorbed by the frame 1. The manual dosing device sits well in one's hand and provides the user with a pleasant tactile feeling so that the phenomenon of fatigue from longer handling can be delayed. When polypropylene is used, very good chemical resistance also exists, wherein the housing 24 of the manual dosing device is dirt-repellent and can easily be cleaned.

Figure 7:
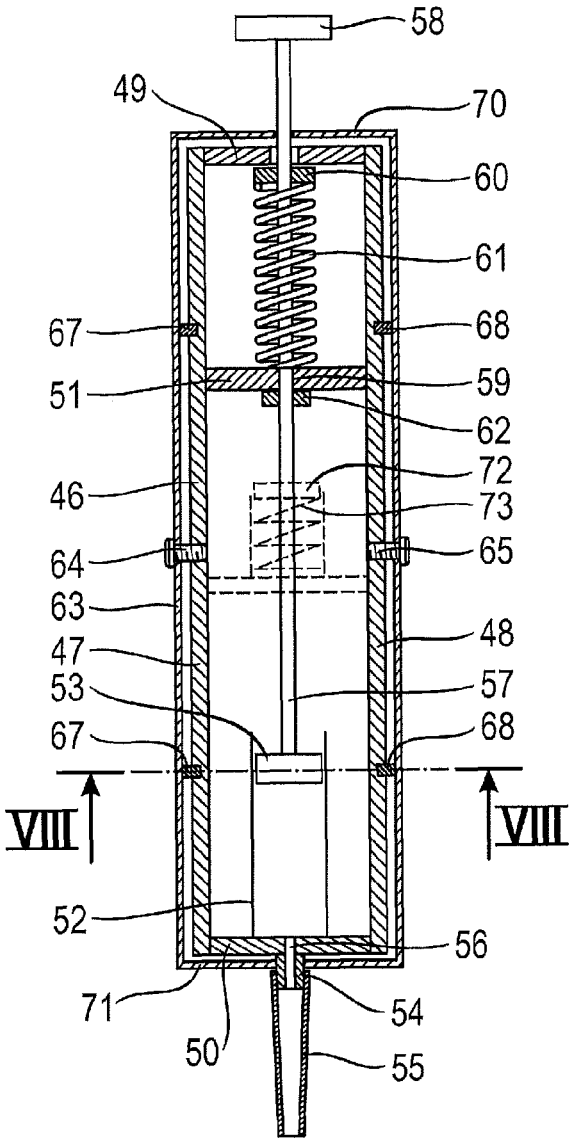
FIG. 7 A lengthwise section of another manual dosing device according to the invention.
Figure 8:
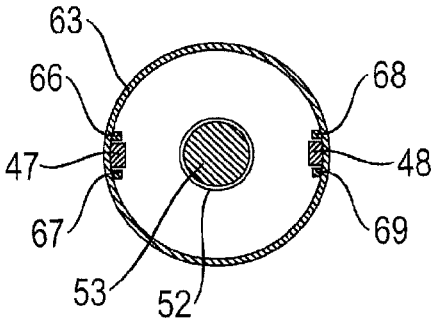
FIG. 8 The same manual dosing device in a section along the line VIII-VIII from FIG. 7.

The manual dosing device shown in FIGS. 7 and 8 is a pipette, i.e., an air cushion dosing device, that is equipable with a pipette tip in order to draw a specific amount of fluid into the pipette tip and eject it therefrom.

The dosing device in FIGS. 7 and 8 has a frame 46 with two spaced, parallel lengthwise members 47, 48. The parallel lengthwise members 47, 48 are connected to each other at the top by a disc shaped bearing plate 49 aligned perpendicular to the lengthwise members, and at the bottom by a disc-shaped support plate 50. Furthermore, the lengthwise members 47, 48 are bridged at their ends by a cross brace 51.

Fixed to the top side of the support plate is a cylinder 52 in which a plunger 53 is arranged such that it is displaceable toward the lengthwise members 47, 48 and is sealed peripherally to the cylinder 52.

A conical (or alternately a cylindrical) pin 54 projects from the bottom side of the support plate 50 in the longitudinal direction of the lengthwise members 47, 48, and a pipette tip can be clamped thereupon.

The interior of the cylinder 52 is connected via a channel 56 that extends through the support plate 50 and the pin 54 to a hole in the bottom end of the pin 54.

The plunger 53 is connected at the top to a lifting rod 57 that is arranged in the center between the two lengthwise members 47, 48. The lifting rod 57 extends upward out of a hole in the bearing plate 49. At the top end, the lifting rod 57 has an actuating button 58.

In the center, the cross brace 51 has a slideway 59 in which the lifting rod 57 is displaceably guided toward the lengthwise members 47, 48.

Below the bearing plate 49, a thrust bearing 60 is fixed to the lifting rod 57. A return spring 61 in the form of a helical spring abuts the cross brace 51 at the bottom and the thrust bearing 60 at the top.

In addition, a peripheral bead 62 or one or more projections with a different design that define a top stop of the lifting rod 57 sits below the cross brace 51 on the lifting rod 57. The return spring 61 is pretensioned such that it presses the lifting rod 57 upward until the bead 62 lies against the bottom side of the cross brace 51. The manual dosing device is shown in this home position in FIGS. 7 and 8.

In addition, the manual dosing device has a housing 63 that encases the frame 46 formed from the lengthwise members 47, 48, bearing plate 49, support plate 50 and cross brace 51. The housing 63 is fixed by means of two screws 64, 65 approximately to the middle of the lengthwise members 47, 48.

In addition, small guide projections 66, 67, 68, 69 extend from the inside of the housing 63 to the front side and the rear side of each lengthwise member 47, 48. The guide projections 66 to 69 guide the housing 63 above and below the screws 64, 65 on the lengthwise members 47, 48.

The housing 63 encompasses the frame 47, 48, 49, 50, 51 like a sleeve. In the example, the housing 63 is circular cylindrical. Other sleeve shapes are also possible.

The housing 63 consists of e.g. two sections of a barrel, the first section being pushed onto the frame to the upper side and the second section to the lower side and the sections of the barrel overlapping each other in a region near the screws 63, 65 and the sections are fixed by the screws 64, 65 to the frame 46. Alternatively, the housing 63 is divided in two halves a plane extending through the longitudinal members 47, 48, each half of the housing being fixed by two screws 64, 65 to frame 46.

At the top, the housing 63 covers the bearing plate 49 with a top wall 70, and at the bottom, it covers the support plate 50 with a floor wall 71. The top wall 70 is at a short distance from the bearing plate 49, and the floor wall 71 is at a short distance from the support wall 50 to enable adjustment in length.

The frame 47, 48, 49, 50, 51 consists of a rigid or stiff material, preferably a plastic. The housing 63 consists of a thin and soft material, preferably a plastic (such as polypropylene).

This manual dosing device is used by first clamping a pipette tip 55 onto the pin 54. To draw liquid through the pipette tip 55, the actuating button 58 is pressed downward until the plunger 53 lies on the bottom end of the cylinder 52. Then the bottom opening of the pipette tip 55 is immersed in liquid. Then the actuating button 58 is released, and the return spring 61 returns the lifting rod 57 with the plunger 53 to the home position in FIGS. 7 and 8. Liquid is thereby drawn through the bottom opening into the pipette tip 55.

The pipette tip 55 is then raised with the manual dosing device and directed toward a different container into which it is to be discharged. When the actuating button 58 is pressed downward, the plunger 53 displaces an air column that presses the drawn liquid out of the pipette tip 55.

The downward movement of the lifting rod 57 is alternatively limited by an abutment element 72, against which bead 62 abuts on its downward travel. In FIG. 7 abutment element 72 and spring element 72 supporting element 72 on frame 46 are shown in dotted lines. After bead 62 abuts abutment element 72 it is possible to conduct an overstroke of lifting rod 57 by applying an increased force to actuating button 58. The overstroke serves for blowing out residual fluid from the pipette tip 55.

With this manual dosing device, the force exerted upon attaching the pipette tip 55 and upon actuating the actuating button 58 is absorbed by the frame 46. Due to the housing 63 arranged on the frame 46, the manual dosing device sits well in one's hand and gives the user a pleasant tactile sensation which delays symptoms of fatigue during longer use. In addition, the housing 63 can consist of chemically-resistant and dirt-resistant materials such as polypropylene.

The manual dosing device from FIGS. 7 and 8 is a fixed volume pipette that can fix the dosing volume when the bead 62 contacts the cross brace 51 and the stop of the piston 53 lies against the floor of the cylinder 52. The invention relates to a pipette with an adjustable dosing volume. With these pipettes, the position of the top stop for the lifting rod is adjustable by means of a setting device for changing the dosing volume.

This completes the description of the preferred and alternate embodiments of the invention. Those skilled in the art may recognize other equivalents to the specific embodiment described herein which equivalents are intended to be encompassed by the claims attached hereto.

What is claimed is:

1. A manual dosing device comprising:

an elongated frame as a support structure which is formed by strip-shaped parallel longitudinal members, the elongated frame having a bottom end which includes means for releasably holding a syringe, the syringe having a plunger as displacement member, drive means for generating a linear movement and fastened to said support structure above the means for releasably holding to the elongated frame, a rod as a displacement means for displacing a fluid in the syringe, the rod being driveable by the drive means, axially connected to means for releasably holding the syringe plunger, and axially guided on the frame, a housing encasing the elongated frame, the elongated frame with means for releasably holding the syringe and the drive means being premounted before the housing is attached, and said housing being attached to the frame at one or two points such that the forces of the drive means driving the plunger are introduced into the frame and are substantially absorbed by the frame.

2. A manual dosing device comprising;

an elongated frame as a support structure which has two parallel strip-shaped longitudinal members, the elongated frame including a bottom end which has means for releasably holding a pipette tip, a housing encasing the elongated structure, a drive means attached to the elongated frame above the means for holding the pipette tip, a cylinder with a plunger as a displacement means, the cylinder being fixed to the elongated frame and connected to the means for releasably holding the pipette tip, the plunger being connected to the drive means in order to displace any fluid in the pipette tip, the frame, the cylinder with the plunger, the means for releasably holding pipette tips and the drive means being premounted before the housing is attached, said housing being attached to the frame at one or two points such that the forces of the drive means driving the plunger are introduced into the frame and are substantially absorbed by the frame, and the means for releasably holding the pipette tip including a hole, the cylinder being connected to the hole through a passage, the hole communicating with the top tip of a pipette tip, when the means for releasably holding holds a pipette tip.

3. The manual dosing device according to claim 2, wherein the elongated frame is formed from a separate bottom part and a separate top part.

4. The manual dosing device according to claim 3, wherein the top and bottom frame parts comprise interlocking connecting structures, and said interlocking connecting structures have fastening members that are connected with each other.

5. The manual dosing device according to claim 2, wherein the parallel, strip-shaped longitudinal members are connected at the bottom end to the means for releasably holding a pipette tip.

6. The manual dosing device according to claim 5, further including a support plate and wherein the parallel, strip-shaped longitudinal members are connected at the bottom end to the support plate.

7. The manual dosing device according to claim 6, wherein the support plate is connected via fork-shaped connecting areas to bottom ends of the parallel~strip-shaped longitudinal members.

8. The manual dosing device according to claim 1, further comprising a bearing plate connecting the parallel, strip-shaped longitudinal members to each other at the top of said parallel, strip-shaped longitudinal members.

9. The manual dosing device according to claim 1, wherein the parallel, strip-shaped longitudinal members include a cross brace connecting the parallel, strip-shaped longitudinal members together.

10. The manual dosing device according to claim 9, further including a slideway integrated in the cross brace for guiding said rod.

11. The manual dosing device according to claim 1, wherein the elongated frame includes two bearing blocks projecting from a side of said elongated frame, and the housing accommodates the bearing blocks in a lateral convexity.

12. The manual dosing device according to claim 1, wherein the housing is divided in the longitudinal direction of the elongated frame, and the elongated frame is composed of parts that have snap connections with each other.

13. The manual dosing device according to claim 1, wherein the elongated frame has an exterior and a longitudinal direction and the housing is positioned on the exterior of the elongated frame in the longitudinal direction of the elongated frame.

14. The manual dosing device according to claim 1, wherein the housing is made of polypropylene or another polyolefin.

* * * * *

UNITED STATES PATENT AND TRADEMARK OFFICE

CERTIFICATE OF CORRECTION

PATENT NO. : 9,180,446 B2
APPLICATION NO. : 13/644254
DATED : November 10, 2015
INVENTOR(S) : Burkhardt Reichmuth It is certified that error appears in the above-identified patent and that said Letters Patent is hereby corrected as shown below:

In the claims

Column 12, Line 30, delete "~" between parallel and strip-shaped

Signed and Sealed this
Twelfth Day of April, 2016

Michelle K. Lee

Michelle K. Lee
*Director of the United States Patent and Trademark Office*